US010088271B2

(12) United States Patent
Maltan et al.

(10) Patent No.: US 10,088,271 B2
(45) Date of Patent: Oct. 2, 2018

(54) FIRING DEVICE FOR FIRING CARTRIDGE AMMUNITION

(71) Applicant: Rheinmetall Waffe Munition GmbH, Unterluess (DE)

(72) Inventors: Johannes Maltan, Ramsau (DE); Wolfgang Kittl, Piding (DE); Michael Krebs, Anger (DE); Florian Huber, Anger (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 457 days.

(21) Appl. No.: 14/888,604

(22) PCT Filed: Mar. 10, 2014

(86) PCT No.: PCT/EP2014/054602

§ 371 (c)(1),
(2) Date: Mar. 4, 2016

(87) PCT Pub. No.: WO2014/154473

PCT Pub. Date: Oct. 2, 2014

(65) Prior Publication Data

US 2016/0195362 A1 Jul. 7, 2016

(30) Foreign Application Priority Data

Mar. 28, 2013 (DE) ..... 10 2013 005 378

(51) Int. Cl.
*F41C 27/06* (2006.01)
*F41A 9/58* (2006.01)
(Continued)

(52) U.S. Cl.
CPC ..... *F41C 27/06* (2013.01); *F41A 9/55* (2013.01); *F41A 9/58* (2013.01); *F42B 5/155* (2013.01)

(58) Field of Classification Search
CPC ..... F41C 27/06; F42B 30/10; F42B 30/04; F42B 8/18; F42B 8/20; F41A 9/58
See application file for complete search history.

(56) References Cited

U.S. PATENT DOCUMENTS 2,397,572 A 4/1946 Weaver
3,365,828 A * 1/1968 Badali ..... F41A 9/37 42/105

(Continued)

FOREIGN PATENT DOCUMENTS

DE 692 16 185 T2 4/1997
DE 10 2005 006 062 A1 8/2006

(Continued)

*Primary Examiner* — Benjamin P Lee
(74) *Attorney, Agent, or Firm* — Muncy, Geissler, Olds & Lowe, P.C.

(57) ABSTRACT

A firing device for firing cartridge ammunition comprising a case head, which has on its outer circumference at least one peripheral, groove-shaped depression. In order to achieve secure arrestment of the ammunition in the firing device when the firing device is loaded from the muzzle end, a head piece and a tubular ammunition receiving-device is provided, wherein the ammunition receiving-device is arranged such that it can be moved axially in the direction of the head piece against the pressure of a restoring element. In this case, the head piece includes an annular guiding element, which extends axially into the ammunition receiving-device and has multiple guiding openings, which extend through the wall of the guiding element and are in each case of a form that is angled from the outer side of the guiding element in the direction of the opening of the ammunition receiving-device.

14 Claims, 2 Drawing Sheets

(51) Int. Cl.
*F42B 5/155* (2006.01)
*F41A 9/55* (2006.01)

(56) References Cited

U.S. PATENT DOCUMENTS 3,390,475 A * 7/1968 Badali ..... F41A 9/37 42/49.01
3,404,478 A * 10/1968 Silsby ..... F41C 27/06 42/105
3,408,761 A * 11/1968 Silsby ..... F41A 3/04 42/105
3,418,879 A * 12/1968 Reed ..... F41A 9/58 89/33.01
3,421,242 A * 1/1969 Lizza ..... F41A 15/00 42/105
3,507,067 A * 4/1970 Into ..... F41A 19/40 42/10
3,557,482 A * 1/1971 Hoover ..... F41C 27/06 42/1.07
3,611,867 A * 10/1971 Silsby ..... F41A 21/28 42/105
3,641,691 A * 2/1972 Ellis ..... F41C 27/06 42/105
4,616,554 A * 10/1986 Spink ..... F41F 3/052 89/1.806
5,305,679 A 4/1994 Begneu
5,695,883 A 12/1997 Harada et al.
8,356,554 B2 * 1/2013 Nurminen ..... F41F 3/052 102/445
2005/0109202 A1 * 5/2005 Muller ..... F41A 9/58 89/34
2007/0068057 A1 * 3/2007 Macaluso ..... F41C 7/025 42/105
2010/0154764 A1 6/2010 Liao
2010/0288112 A1 * 11/2010 Reunamaki ..... F41F 1/06 89/27.13
2014/0237883 A1 * 8/2014 Hosz ..... F41C 27/00 42/105

FOREIGN PATENT DOCUMENTS

DE 10 2005 016 879 A1 10/2006
DE 10 2011 050 685 A1 11/2012
DE 20 2012 008 824 U1 1/2013
EP 0 532 721 B1 12/1996
FR 2 520 860 A1 8/1983
WO WO 03/073034 A1 9/2003

* cited by examiner

FIRING DEVICE FOR FIRING CARTRIDGE AMMUNITION

CROSS REFERENCE TO RELATED APPLICATIONS

This application is a national stage of International Application No.: PCT/EP201.4/054602, which was filed on Mar. 10, 2014, and which claims priority to German Patent Application No.: 10 2013 005 378.1, which was filed in Germany on Mar. 28, 2013, and which are both herein incorporated by reference.

The invention relates to a firing device or a launcher for firing cartridge ammunition, with a case head, which has on its outer circumference at least one peripheral, groove-like depression, but with the priority of receiving and arresting the ammunition in the firing device. Particularly in firing devices, such as grenade launchers, in which the ammunition is loaded into the weapon from the front, i.e. from the muzzle, the problem is often that the ammunition cannot be reliably arrested and that movements of the grenade launcher (e.g. vibration or shock stresses) can move it axially within the barrel.

To securely arrest the ammunition after loading the weapon, these firing devices are partially structured such that the respective ammunition is not loaded from the front but instead from the sides or the rear, into the respective mortars, and then also arrested by a locking device. Such loading and locking devices, however, are associated with a relatively space-consuming and costly construction of the respective weapon.

From DE 10 2011 050 685 A1, such a weapon with a straightening device and a method of operating the weapon are known. Here, the magazine is arranged in front of the muzzle end of a gun barrel.

DE 692 16 185 T2 (EP 0532721 B1) describes a mortar with a drum magazine. Both DE 10 2005 0 6 879 A1 and DE 10 2005 006 062 A1 feature devices for unloading a mortar cartridge. The object of the invention is to disclose a firing device, especially for firing launcher ammunition, with which the loading of ammunition via the muzzle of the respective weapon is possible, wherein after loading, the ammunition can be securely arrested in the firing device as well as easily unloaded from the firing device.

This object is achieved by the features of claim 1. Further, particularly advantageous embodiments of the invention are disclosed in the dependent claims.

From DE 20 2012 008 824 111, a firing device with an ammunition locking mechanism is known, in which in particular the removal of ammunition from the magazine takes place without application of force on the ammunition. Accordingly, a threaded sleeve of the fastening and securing device is pulled backwards, which in turn acts on a washer that guides a cylindrical pin upwards in a groove and thereby frees the entire pipe diameter for unloading or loading. A wave spring keeps the cylindrical pin in position. This design allows for the loading and unloading of munitions from the muzzle side of the weapon.

The present invention is in turn mainly based on the idea that the firing device comprises a head piece and a tubular ammunition receiving-device which is fastened to the front of the head piece and forms the barrel. This ammunition receiving-device is movably disposed against the pressure of a restoring element, axially in the direction of the head piece. In this case, the head piece has an annular guiding element, which extends axially into the ammunition receiving-device and contains several guiding openings which are arranged distributed over the circumference and extend through the wall of the guiding element. The guiding openings each feature an obliquely directed path from the outside of the guiding element towards the muzzle of the ammunition receiving-device. In the respective guiding opening, a locking element is slidably disposed and is acted upon by a spring element on the side facing away from the ammunition receiving-device, such that when the firing device is loaded, the locking elements are pressed by the spring elements into the groove-shaped depression of the ammunition. In addition, the locking elements are displaceably arranged by the ammunition receiving-device, in such a way that upon an axial displacement of the ammunition receiving-device in the direction of the head piece, the locking elements are pushed from the groove-shaped depression of the ammunition into the guiding openings of the guiding element against the pressure of the spring elements, and that with a loaded firing device, the arresting of the ammunition is canceled by the locking elements, so that the ammunition can be discharged on the muzzle side. When unloading the ammunition, the locking elements are thus pushed into the guiding openings of the guiding element through axial displacement of the ammunition receiving-device towards the head piece and out of the groove-shaped depression of ammunition.

The launching device of the invention offers, among other things, the advantage that the ammunition locking mechanism requires only minimal installation and operating space. In addition, the recoil forces that occur during firing act upon the head piece of the firing device without mechanically stressing the actual locking mechanism.

Preferably, the head piece and the ammunition receiving-device can be detachably interconnected with one another, for example by means of a bayonet joint. This makes it easy to mount or dismantle the firing device.

The locking elements may be, for example, pin-shaped locking elements, in particular cylindrical pins, which are acted upon, for example, by spring elements designed as wave springs.

Further details and advantages of the invention will become apparent from the following, explained in the exemplary embodiments with reference to the figures.

Shown are:

Figure 1:
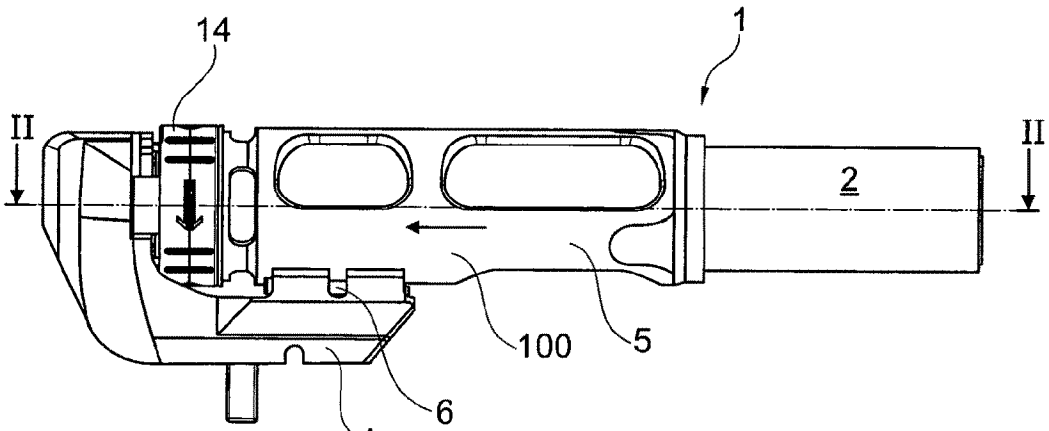
FIG. 1 shows the side view of a firing device according to the invention, loaded with ammunition.
Figure 2:
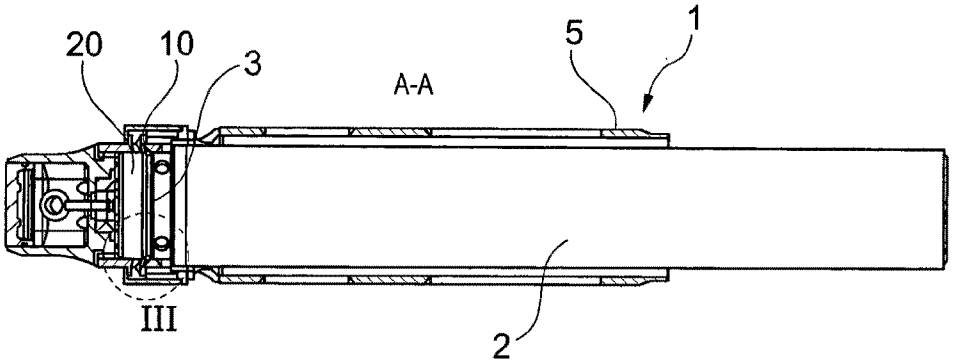
FIG. 2 is a longitudinal cross-section along the intersection line, labeled as II-II in FIG. 1.

In FIGS. 1 and 2, a launching device according to the invention is denoted by 1, which is a firing device or a weapon launch system, etc., for firing cartridge ammunition, for example, pyrotechnic ammunition 2 (also submunitions with effective masses). On its rear side, the ammunition 2 has a case head 20 with at least one, groove-shaped depression 3, revolving on its outer circumference.

The firing device 1 comprises a head piece 4 and a tubular ammunition receiving-device 5, which is attached to the head piece 4 by its front side. The head piece 4 and the ammunition receiving-device 5 are detachably interconnected via a connection 14, preferably a bayonet connection. The ammunition receiving-device 5 is in turn slidably and axially disposed in the direction of the head piece 4 against the pressure of a spring 6, which is indicated in FIG. 1 by an arrow 100.

Figure 3:
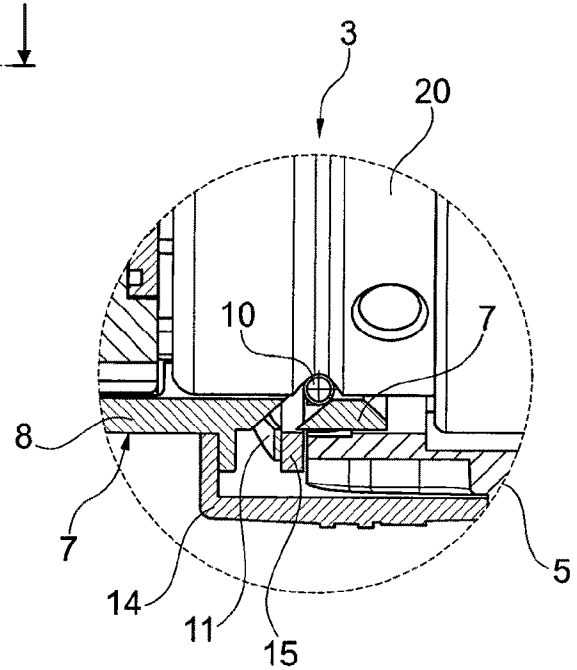
FIG. 3 is an enlarged view of the section, identified in FIG. 2 as III.

The head piece 4 comprises an annular guiding element 7 (FIG. 3), which axially extends into the ammunition receiving-device 5, such that the groove-shaped depression 3 of the ammunition 2 is at least partially enclosed by the annular guiding element 7 after loading.

Figure 4:
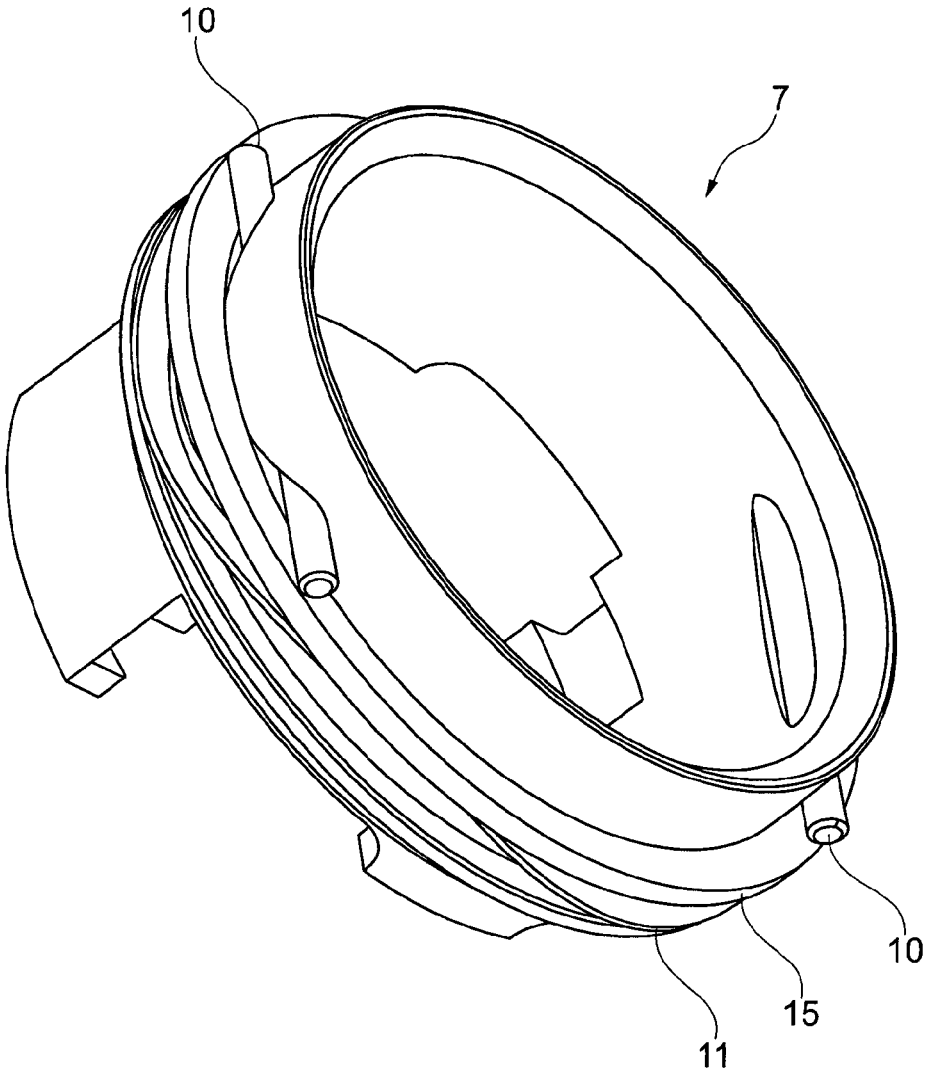
FIG. 4 is a perspective view of the arresting device of the firing device.

The annular guiding element 7 preferably contains two openings 9 which are uniformly and laterally disposed on the circumference and extend transversely through the wall 8 (FIG. 4) of the guiding element 7. In this exemplary embodiment, the openings 9 extend obliquely rearward to the head piece 4.

Each opening 9 of the guiding element 7 serves for receiving a cylindrical pin 10 which is slidably integrated along the sloped path toward the head piece 4. These cylindrical pins 10 are acted upon by a wave spring 11 that is integrated in the guiding element 7 (FIG. 4), such that during loading, the cylindrical pins 10 are pressed by the wave spring 11 into the openings 9 and thus into the groove-shaped depression 3 of the ammunition 2, thereby locking the munition into position. The wave spring 11 thereby is supported by a movable ring 15, which abuts the cylindrical pins 10.

The cylindrical pins 10 can be displaced by the ammunition receiving-device 5, such that when an axial displacement of the ammunition receiving-device 5 against the pressure of the wave springs 11, 12, in the direction of the arrow 100 (i.e. toward the head piece 4) takes place, the cylinder pins 10 are moved out from the groove-shaped depression 3 of the ammunition 2 into the guiding openings 9 of the guiding element 7, so that the locking of the ammunition 2 is lifted by the cylinder pins 10, and the ammunition 2 can be discharged.

The procedure is as follows:

For loading or loading up the firing device 1, the pyrotechnic ammunition 2 is inserted into the muzzle 12 of the ammunition receiving-device 5. By pushing the ammunition 2 into the ammunition receiving-device 5, the front edge-side portion 21 of the case head 20 of the ammunition 2 reaches the cylindrical pins 10 protruding into the loading area 13 of the firing device 1. These are then pushed against the pressure of the wave springs 11, 12 into the guiding openings 9 of the guiding elements 7, so that the ammunition can be axially pushed further into the firing device 1 until the cylindrical pins 10 engage in the groove-shaped depression 3 of the ammunition and arrest the ammunition 2 in the firing device 1. The guiding element 7 and the wave spring 11 then prevent the ammunition 2 from moving towards the muzzle 12 of the ammunition receiving-device 5.

To unload the ammunition 2, the ammunition receiving-device 5 is pressed in the direction of the arrow 100. This urges both the spring 6 and the cylindrical pins 10 axially toward the head piece 4. The guiding openings 9 of the guiding element 7 then guide the cylindrical pins 10 outwards, so that the arresting of the ammunition 2 is canceled and discharge on the muzzle side can be achieved.

LIST OF REFERENCE NUMBERS

1 firing device, grenade launcher
2 (pyrotechnic) ammunition
3 groove-shaped depression
4 head piece
5 ammunition receiving-device
6 restoring element, spring
7 guiding element
8 wall
9 guiding opening
10 (pin-shaped) locking element, cylindrical pin
11 spring element, wave spring
12 muzzle
13 loading area
14 connection
15 ring (support for wave spring)
20 case head
21 edge-side area
100 arrow

The invention claimed is:

1. A firing device for firing cartridge ammunition with a case head, having on its outer circumference at least one circumferential, groove-shaped depression, the firing device comprising:

a head piece; and a tubular ammunition receiving-device fixed to a front-side of the head piece;

wherein the ammunition receiving-device is slidably mounted against the pressure of a restoring element, axially in the direction of the head piece; and wherein the head piece has an annular guiding element, which axially extends inside of the ammunition receiving-device, such that when the firing device is loaded with the ammunition, the groove-shaped depression of the ammunition is at least partially enclosed by the annular guiding element.

2. The firing device according to claim 1, wherein the annular guiding element includes multiple guiding openings, in each of which a locking element is slidably disposed, and which are arranged distributed over the periphery and which extend through a wall of the guiding element.

3. The firing device according to claim 2, wherein the guiding openings are each obliquely directed from the outside of the guiding element to a muzzle of the ammunition receiving-device.

4. The firing device according to claim 2, wherein the locking elements are acted upon by spring elements, on the side facing away from the ammunition receiving-device, such that when the firing device is loaded with the ammunition, the locking elements of the spring elements are pressed into the groove-shaped depression of the ammunition to lock the ammunition.

5. The firing device according to claim 4, wherein the locking elements are displaceably arranged by the ammunition receiving-device in such a way that upon an axial displacement of the ammunition receiving-device in the direction of the head piece, the locking elements are slidable against the pressure of the spring elements from the groove-shaped depression of the ammunition into the guiding openings of the guiding element, so that the locking of the ammunition is lifted by the locking elements.

6. The firing device according to claim 4, wherein the spring elements acting on the locking elements are wave springs.

7. The firing device according to claim 6, wherein the wave springs circumferentially surround the annular guiding element and abut against a first side of a movable ring that is slidably mounted on the annular guiding element, wherein a second side of the movable ring, that opposes the first side, abuts the locking elements, such that the wave springs act on the locking elements via the movable ring.

8. The firing device according to claim 4, wherein the locking elements are cylindrical pins, wherein the cylindrical pins each have a cylindrical body portion and two end faces, and wherein the cylindrical body portion contacts the groove-shaped depression when the ammunition is locked.

9. The firing device according to claim 2, wherein the locking elements are pin-shaped.

10. The firing device according to claim 2, wherein the locking elements are cylindrical pins.

11. The firing device according to claim 10, wherein the cylindrical pins are each slidable in a direction that is transverse to the longitudinal axis of the cylindrical pins.

12. The firing device according to claim 1, wherein the head piece and the ammunition receiving-device are detachably interconnected.

13. The firing device according to claim 12, wherein the head piece and the ammunition receiving-device are interconnected via a bayonet connection.

14. The firing device according to claim 1, wherein the restoring element is a spring.

* * * * *